US009834023B2

(12) United States Patent
Kobayashi

(10) Patent No.: US 9,834,023 B2
(45) Date of Patent: Dec. 5, 2017

(54) THERMAL TRANSFER SHEET

(71) Applicant: Dai Nippon Printing Co., Ltd., Tokyo (JP)

(72) Inventor: Yoshimasa Kobayashi, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 15/127,559

(22) PCT Filed: Mar. 24, 2015

(86) PCT No.: PCT/JP2015/058912
§ 371 (c)(1),
(2) Date: Sep. 20, 2016

(87) PCT Pub. No.: WO2015/146979
PCT Pub. Date: Oct. 1, 2015

(65) Prior Publication Data

US 2017/0129267 A1 May 11, 2017

(30) Foreign Application Priority Data

Mar. 26, 2014 (JP) ..... 2014-064700

(51) Int. Cl.
*B41M 5/382* (2006.01)
*B41M 5/44* (2006.01)
(Continued)

(52) U.S. Cl.
CPC ..... *B41M 5/44* (2013.01); *B41M 5/3856* (2013.01); *B41M 5/38214* (2013.01);
(Continued)

(58) Field of Classification Search
CPC ..... B41M 5/382; B41M 5/38207; B41M 5/38214; B41M 5/42; B41M 5/44;
(Continued)

(56) References Cited

U.S. PATENT DOCUMENTS

2014/0212604 A1 7/2014 Suzuki et al.

FOREIGN PATENT DOCUMENTS

JP 8-300842 A 11/1996
JP 2000-103175 A 4/2000
(Continued)

OTHER PUBLICATIONS

International Search Report dated Jun. 2, 2015, issued for PCT/JP2015/058912.

*Primary Examiner* — Bruce H Hess
(74) *Attorney, Agent, or Firm* — Locke Lord LLP

(57) ABSTRACT

The present invention is to provide a thermal transfer sheet which is able to prevent a heat resistant slipping layer from transferring to a guide roller, etc., and which is able to prevent wrinkles when printing. Disclosed is a thermal transfer sheet including a substrate sheet, a thermal transfer layer disposed on one side of the substrate sheet, and a heat resistant slipping layer disposed on the other side of the substrate sheet via a primer layer, wherein the primer layer contains a cured product of a resin composition containing one or more kinds of resins selected from a urethane resin and a polyester resin and a compound having a functional group selected from an epoxy group, a silanol group and a hydrolyzable silyl group.

2 Claims, 1 Drawing Sheet

(51) Int. Cl.
*B41M 5/39* (2006.01)
*B41M 5/385* (2006.01)

(52) U.S. Cl.
CPC ..... *B41M 5/39* (2013.01); *B41M 5/443* (2013.01); *B41M 2205/02* (2013.01); *B41M 2205/04* (2013.01); *B41M 2205/30* (2013.01); *B41M 2205/36* (2013.01)

(58) Field of Classification Search
CPC ..... B41M 5/443; B41M 2205/02; B41M 2205/04; B41M 2205/30; B41M 2205/36
USPC ..... 503/227; 428/32.64–32.68
See application file for complete search history.

(56) References Cited

FOREIGN PATENT DOCUMENTS

| | | | |
|---|---|---|---|
| JP | 2011-201092 | A | 10/2011 |
| JP | 2014-051052 | A | 3/2014 |
| WO | 2013/047560 | A1 | 4/2013 |

THERMAL TRANSFER SHEET

TECHNICAL FIELD

The present invention relates to a thermal transfer sheet.

BACKGROUND ART

Various kinds of thermal transfer recording methods are well-known. Of them, a thermal fusion transfer recording method and a thermal sublimation transfer recording method are known as widely-used methods.

The thermal fusion transfer recording method is such an image forming method that, by applying energy corresponding to image information to a heating device such as thermal head, heat is applied to a thermal transfer sheet in which a thermofusible color layer is disposed on a substrate, the thermofusible color layer containing a thermofusible binder (e.g., resin or wax) and color materials (e.g., pigments) dispersed in the binder, to thermally transfer the color materials and the binder to a transfer receiving medium such as paper, thereby forming an image.

The thermal sublimation transfer recording method is such an image forming method that, by use of a thermal transfer sheet in which a sublimation color layer containing a sublimation dye is disposed on a substrate, the sublimation dye is thermally transferred to the dye receiving layer of a thermal transfer image receiving sheet, thereby forming an image. According to this method, a full color image can be reproduced by transferring three or more colors to the dye receiving layer of the thermal transfer image receiving sheet for gradation image printing, with controlling the amount of heat applied with a thermal head when thermal transfer.

In these thermal transfer sheets, to prevent fusion between the substrate sheet (the rear side (not the color layer side) of the substrate sheet) and the thermal head (heating means), a heat resistant slipping layer is disposed on the opposite side from the color layer side of the substrate sheet, or a primer layer is further disposed between the substrate sheet and the heat resistant slipping layer.

However, with the speed up of thermal transfer printers in recent years, there is a tendency for thermal energy generated from thermal heads to increase, thus leading to problems such as fusion sticking of the thermal head and the heat resistant slipping layer of the thermal transfer sheet, wrinkles in printed images, and rupture in the thermal transfer sheet.

A thermal transfer sheet is disclosed in Patent Document 1, which has flexibility and heat-resistance and thus is resistant to rupture. In the thermal transfer sheet, a specific heat resistant slipping layer is formed on the opposite side from a color layer side of a substrate sheet, via a specific primer layer composed of a crosslinking agent and a specific binder resin. In Patent Document 1, it is described that from the viewpoint of flexibility, etc., the crosslinking agent is preferably a titanium chelate agent or an isocyanate compound, and the binder resin is preferably a polyvinyl alcohol resin or a polyvinyl butyral resin.

CITATION LIST

Patent Document 1: Japanese Patent Application Laid-Open No. 2011-201092

SUMMARY OF INVENTION

Technical Problem

A conventional thermal transfer sheet such as the thermal transfer sheet as disclosed in Patent Document 1, which has the primer layer composed of a polyvinyl acetal resin and a chelate agent, may cause a manufacturing defect when it is conveyed, which is such a defect that a part of the heat resistant slipping layer brought into contact with a guide roller attaches and transfers to the guide roller side. Also, such a conventional thermal transfer sheet is likely to cause a printing failure (printing wrinkles) that occurs when the thermal transfer sheet gets twisted when printing.

The present invention was achieved in light of the above circumstance. An object of the present invention is to provide a thermal transfer sheet which is able to prevent the heat resistant slipping layer from transferring to the guide roller, etc., and which is able to prevent wrinkles when printing.

Solution to Problem

The thermal transfer sheet of the present invention is a thermal transfer sheet including substrate sheet, a thermal transfer layer disposed on one side of the substrate sheet, and a heat resistant slipping layer disposed on the other side of the substrate sheet via a primer layer, wherein the primer layer contains a cured product of a resin composition containing one or more kinds of resins selected from a urethane resin and a polyester resin and a compound having a functional group selected from an epoxy group, a silanol group and a hydrolyzable silyl group.

In the thermal transfer sheet, the heat resistant slipping layer preferably contains a hydroxyl group-containing thermoplastic resin, from the point of view that the adhesion to the primer layer is increased to increase the effect of preventing the heat resistant slipping layer from transferring.

Advantageous Effects of Invention

According to the present invention, the thermal transfer sheet which is able to prevent the heat resistant slipping layer from transferring and which is able to prevent wrinkles when printing, can be provided.

DESCRIPTION OF EMBODIMENTS

The thermal transfer sheet of the present invention is a thermal transfer sheet including substrate sheet, a thermal transfer layer disposed on one side of the substrate sheet, and a heat resistant slipping layer disposed on the other side of the substrate sheet via a primer layer, wherein the primer layer contains a cured product of a resin composition containing one or more kinds of resins selected from a urethane resin and a polyester resin and a compound having a functional group selected from an epoxy group, a silanol group and a hydrolyzable silyl group.

Figure 1:
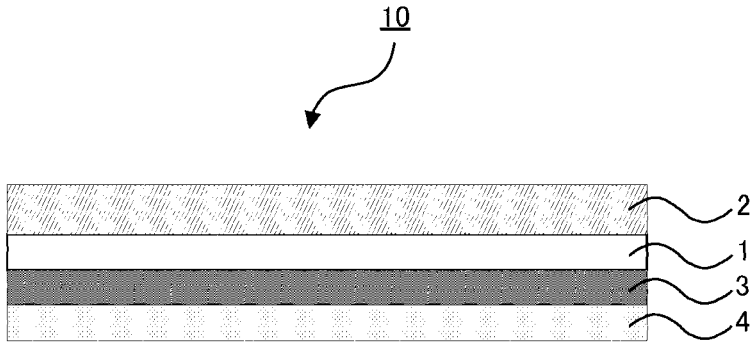
FIG. 1 is a schematic sectional view of an example of the thermal transfer sheet according to the present invention.
Figure 2:
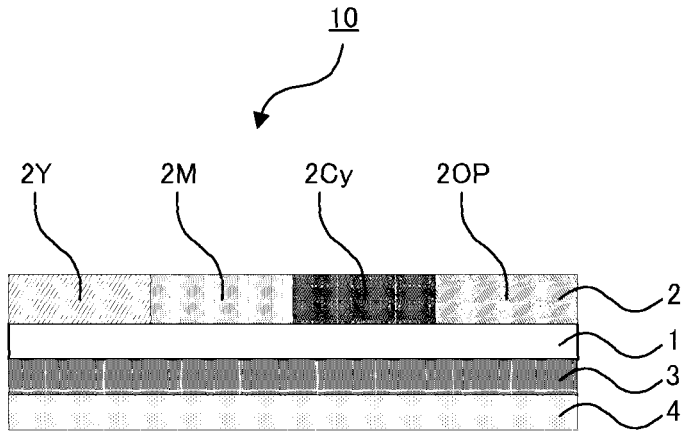
FIG. 2 is a schematic sectional view of another example of the thermal transfer sheet according to the present invention.
Figure 3:
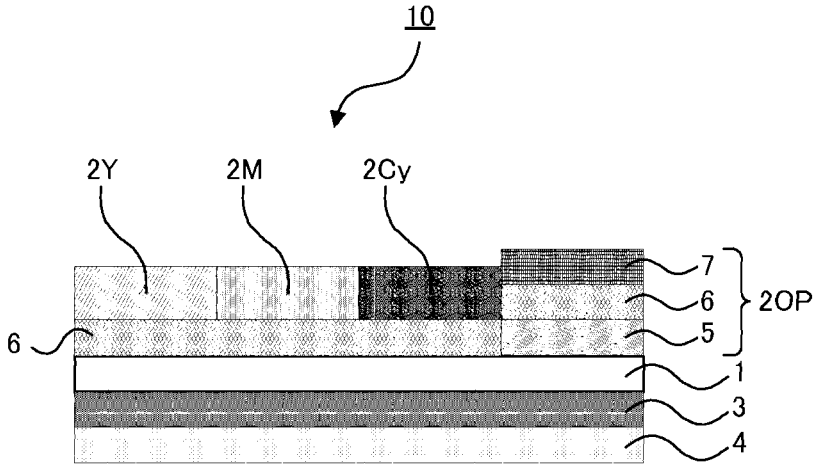
FIG. 3 is a schematic sectional view of another example of the thermal transfer sheet according to the present invention.

The thermal transfer sheet of the present invention will be explained by reference to figures. FIGS. 1 to 3 are schematic sectional views showing examples of the thermal transfer sheet according to the present invention. In the example shown in FIG. 1, a thermal transfer layer 2 is disposed on one side of a substrate sheet 1, and a heat resistant slipping layer 4 is disposed on the opposite side from the thermal transfer layer 2 side of the substrate sheet 1 via a primer layer 3. For example, as shown by the example in FIG. 2, the thermal transfer layer 2 may be such a thermal transfer layer 2 that a color transfer layer 2Y (yellow), a color transfer layer 2M (magenta), a color transfer layer 2Cy (cyan) and a transferable protective layer 2OP are sequentially disposed side by side. Or, as shown by the example in FIG. 3, the thermal transfer layer 2 may be such a thermal transfer layer 2 that a primer layer 6 for color transfer layer is further disposed between the substrate sheet 1 and the color transfer layers 2Y, 2M and 2Cy.

As shown by the example in FIG. 3, the transferable protective layer 2OP may be a laminate made of a plurality of layers. According to the example shown in FIG. 3, the transferable protective layer 2OP is such that an adhesive layer 7 for providing adhesion to an image receiving layer is disposed on the outermost surface; moreover, the primer layer 6 for color transfer layer is disposed between a main protective layer 5 and an adhesive layer 7 so that, after transfer, the main protective layer 5 provided with various resistant properties is disposed on the outermost surface of an image receiving surface.

Also, the thermal transfer sheet of the present invention may be such a thermal transfer sheet that only the color transfer layer is disposed as the thermal transfer layer and any transferable protective layer is not disposed, or it may be such a protective layer transfer sheet that only the transferable protective layer is disposed all over the surface as the thermal transfer layer.

The thermal transfer sheet of the present invention includes the primer layer between the substrate sheet and the heat resistant slipping layer, the primer layer containing a cured product of a resin composition containing one or more kinds of resins selected from a urethane resin and a polyester resin and a compound having a functional group selected from an epoxy group, a silanol group and a hydrolyzable silyl group. Therefore, the thermal transfer sheet of the present invention is a sheet that is able to prevent the heat resistant slipping layer from transferring to a guide roller, etc., and which is able to prevent wrinkles when printing.

To prevent a part of the heat resistant slipping layer brought into contact with the guide roller, etc., from transferring to the guide roller, etc., the inventor of the present invention studied a primer layer that is able to further increase the adhesion between the substrate sheet and the heat resistant slipping layer. As a result, it was found that by use of a primer layer containing a urethane resin or polyester resin, the adhesion can be increased and can prevent the heat resistant slipping layer from transferring to the guide roller, etc. On the other hand, when a urethane resin or polyester resin is used in the primer layer, there is a problem such that wrinkles occur in a thermal head when printing. As a result of considerable research, the inventor of the present invention found that the primer layer affects slipping ability (friction) between the heat resistant slipping layer and the thermal head.

As a result of more research studies based on the above finding, the inventor of the present invention found that by combining a urethane resin or polyester resin with a compound having a functional group selected from an epoxy group, a silanol group and a hydrolyzable silyl group, excellent adhesion to the heat resistant slipping layer can be obtained, and occurrence of wrinkles in the thermal head can be prevented. The reason for exhibiting such effects is not clear yet; however, it is estimated as follows: a crosslinking reaction occurs between an unreacted carboxy group or hydroxy group of the urethane resin or polyester resin, or a functional group introduced to the urethane resin or polyester resin, and the epoxy group, the silanol group, or a silanol group produced by hydrolysis of the hydrolyzable silyl group of the above-described specific compound; therefore, the heat resistance of the primer layer is increased, or appropriate rigidity is provided to the primer layer, resulting in an increase in the slipping ability between the thermal head and the heat resistant slipping layer.

The thermal transfer sheet of the present invention includes at least the substrate sheet, the thermal transfer layer, the primer layer and the heat resistant slipping layer. It may further include other layers, as long as the effects of the present invention are not impaired. Hereinafter, the components of the thermal transfer sheet of the present invention will be explained in order.

(Substrate Sheet)

The substrate sheet used in the present invention is not particularly limited, as long as it has a certain level of conventionally known heat resistance and strength. For example, a resin substrate with a thickness of about 0.5 to 50 μm, preferably 1 to 10 μm, is suitably used in the present invention.

The resin substrate is composed of a resin. Examples of the resin include polyethylene terephthalate, 1,4-polycyclohexylenedimethylene terephthalate, polyethylene naphthalate, polyphenylene sulfide, polystyrene, polypropylene, polysulfone, aramid, polycarbonate, polyvinyl alcohol, cellophane, cellulose derivatives such as cellulose acetate, polyethylene, polyvinyl chloride, nylon, polyimide and ionomer. Of them, polyethylene terephthalate is preferably used.

The substrate may be composed of any one of the above resins, or it may be composed of two or more of the above resins.

From the viewpoint of increasing adhesion, it is preferable to carry out an adhesion treatment on a surface of the substrate sheet, on which the thermal transfer layer or primer layer will be formed. As the adhesion treatment, any known resin surface modifying technique can be used as it is, such as a corona discharge treatment, a flame treatment, an ozone treatment, a UV treatment, a radiation treatment, a surface roughening treatment, a chemical treatment, a plasma treatment, a low temperature plasma treatment, a primer treatment and a grafting treatment. Two or more of these treatments can be used together. The primer treatment can be carried out as follows: at the time of forming a film by melt extrusion of a resin substrate, a primer liquid is applied to an unstretched film, and then the film is stretched. In the present invention, to increase the adhesion between the substrate and the layers, the corona discharge treatment and the plasma treatment are preferred, since they are inexpensive and easy to carry out.

(Primer Layer)

In the present invention, the primer layer is a layer disposed between the substrate sheet and the heat resistant slipping layer, and it contains a cured product of a resin composition containing one or more kinds of resins selected from a urethane resin and a polyester resin and a compound having a functional group selected from an epoxy group, a silanol group and a hydrolyzable silyl group (hereinafter the compound may be simply referred to as "specific compound"). Such a primer layer increases the adhesion between the substrate sheet and the heat resistant slipping layer, increases heat resistance, and prevents wrinkles when printing.

The resin composition for primer layer contains at least one or more kinds of resins selected from a urethane resin and a polyester resin and the above-described specific compound. It may further contain other components, as long as the effects of the present invention are not impaired. Hereinafter, these components will be explained.

<Urethane Resin>

In the present invention, the urethane resin can be appropriately selected from conventionally known urethane resins. In general, urethane resin is synthesized by copolymerization of a polyisocyanate compound having two or more isocyanate groups and a polyol having two or more hydroxy groups, and in general, it contains a residual hydroxy group. Therefore, the hydroxy group can cause a crosslinking reaction with the epoxy group, the silanol group, or a silanol group produced by hydrolysis of the hydrolyzable silyl group of the specific compound to be below, thereby curing the resin composition. As a result, the primer layer is provided with appropriate rigidity; the heat resistance of the primer layer is increased; and wrinkles are prevented when printing, therefore.

In the present invention, the urethane resin is preferably such that a functional group reactive with the epoxy group or silanol group is further introduced thereto. This is because the use of such a urethane resin increases reaction sites with the specific compound to be described below and makes it easy to promote a crosslinking reaction and increase heat resistance. Examples of the functional group reactive with the epoxy group or silanol group include a hydroxy group, a carboxy group, an amino group, a thiol group and ions thereof. The urethane resin may be a urethane resin having any one of the functional groups, or it may be a urethane resin having two or more of the functional groups.

That is, in the present invention, the urethane resin is preferably a urethane resin having one or more functional groups selected from a hydroxy group, a carboxy group, an amino group, a thiol group and ions thereof. From the viewpoint of excellent reactivity with the epoxy group or silanol group of the specific compound, the urethane resin is preferably a urethane resin having one or more functional groups selected from a carboxy group, an amino group, a thiol group and ions thereof.

The glass transition temperature of the urethane resin may be appropriately selected. From the viewpoint of excellent adhesion and prevention of wrinkles when printing, it is preferably 10 to 120° C., more preferably 25 to 70° C. The glass transition temperature (Tg) is a value measured by a dynamic viscoelasticity measuring device (such as "RHEOLOGRAPH SOLID" manufactured by Toyo Seiki Seisaku-sho, Ltd.)

In the present invention, the urethane resin can be obtained by the copolymerization of the polyisocyanate compound and the polyol, each having a desired structure. The method for introducing the functional group reactive with the epoxy group or silanol group to the urethane resin, may be copolymerization using the polyisocyanate compound or polyol having the functional group reactive with the epoxy group or silanol group, or may be addition of the functional group reactive with the epoxy group or silanol group by any known method after the production of the urethane resin.

The urethane resin may be a commercially available product. Preferred examples thereof include AP-40N, AP-40F, AP-30F, AP-20 and AP-10 manufactured by DIC Corporation. In the present invention, the urethane resin may be one kind of urethane resin or two or more kinds of urethane resins.

<Polyester Resin>

In the present invention, the polyester resin can be appropriately selected from conventionally known polyester resins. In general, polyester resin is synthesized by copolymerization of a polyol and a polycarboxylic acid having two or more carboxy groups, and in general, it contains a residual hydroxy group and a carboxy group. Therefore, the hydroxy group and the carboxy group cause a crosslinking reaction with the epoxy group, the silanol group, or a silanol group produced by hydrolysis of the hydrolyzable silyl group of the specific compound to be described below, thereby curing the resin composition. As a result, the primer layer is provided with appropriate rigidity; the heat resistance of the primer layer is increased; and wrinkles are prevented when printing, therefore.

In the present invention, the polyester resin is preferably such that a functional group reactive with the epoxy group or silanol group is further introduced thereto. This is because the use of such a polyester resin increases reaction sites with the specific compound to be described below and makes it easy to promote a crosslinking reaction and increase heat resistance. Examples of the functional group reactive with the epoxy group or silanol group include a hydroxy group, a carboxy group, an amino group, a thiol group and ions thereof. The polyester resin may be a polyester resin having any one of the functional groups, or it may be a polyester resin having two or more of the functional groups.

That is, in the present invention, the polyester resin is preferably a polyester resin having one or more functional groups selected from a hydroxy group, a carboxy group, an amino group, a thiol group and ions thereof. From the viewpoint of excellent reactivity with the epoxy group or silanol group of the specific compound, the polyester resin is preferably a polyester resin having one or more functional groups selected from a carboxy group, an amino group, a thiol group and ions thereof.

The glass transition temperature of the polyester resin may be appropriately selected. From the viewpoint of excellent adhesion and prevention of wrinkles when printing, it is preferably 10 to 120° C., more preferably 25 to 70° C.

In the present invention, the polyester resin can be obtained by the copolymerization of the polycarboxylic acid and the polyol, each having a desired structure. The polyester resin may be a commercially available product. Preferred examples thereof include PLAS COAT Z-730 and Z-760 manufactured by GOO Chemical Co., Ltd. In the present invention, the polyester resin may be one kind of polyester resin or two or more kinds of polyester resins.

In the present invention, any one of the urethane resin and the polyester resin may be used, or the urethane resin and the polyester resin may be used in combination. From the viewpoint of the adhesion of the heat resistant slipping layer, it is preferred to use the urethane resin.

In the present invention, from the viewpoint of excellent adhesion and prevention of wrinkles when printing, the total content ratio of the urethane and polyester resins in the resin composition for primer layer is preferably 60 to 98 parts by mass, more preferably 65 to 95 parts by mass, particularly preferably 85 to 95 parts by mass, with respect to 100 parts by mass of the solid content in the resin composition for primer layer.

In the present invention, solid content means all components other than solvents in the resin composition.

<Compound Having a Functional Group Selected from an Epoxy Group, a Silanol Group and a Hydrolyzable Silyl Group>

In the present invention, the above-described specific compound is used. Since the above-described specific compound has the highly reactive epoxy group or silanol group, it is likely to cause a crosslinking reaction with the urethane resin or the polyester resin to cure. Therefore, the primer layer is provided with appropriate rigidity; the heat resistance of the primer layer is increased; and wrinkles are prevented when printing, therefore.

The hydrolyzable silyl group is a group that produces a silanol group by hydrolysis, and it is a group in which one or more hydrolyzable groups selected from the group consisting of an alkoxy group, an aryloxy group, an acetoxy group, a mercapto group, an amino group and a halogen atom are bound to a silicon atom. Concrete examples thereof include an alkoxysilyl group, a mercaptosilyl group, a halogenosilyl group and an aminosilyl group.

As the above-described specific compound, any compound having one or more functional groups selected from an epoxy group, a silanol group and a hydrolyzable silyl group, can be used. From the viewpoint of curability, a polyfunctional epoxy compound having two or more epoxy groups, a compound having two or more silanol groups or hydrolyzable silyl groups, or an epoxy silane compound having one or more epoxy groups and one or more silanol groups or hydrolyzable silyl groups, is preferred. The above-described specific compound may be one kind of compound or may be a combination of two or more kinds of compounds.

Concrete examples of the polyfunctional epoxy compound that is preferably used as the above-described specific compound include, but are not limited to, aromatic epoxy compounds such as a bisphenol A type epoxy resin, a bisphenol F type epoxy resin, a bisphenol S type epoxy resin, a diphenyl ether type epoxy resin, a hydroquinone type epoxy resin, a naphthalene type epoxy resin, a biphenyl type epoxy resin, a fluorene type epoxy resin, a phenol novolac type epoxy resin, an o-cresol novolac type epoxy resin, a trishydroxyphenylmethane type epoxy resin, and a tetraphenylolethane type epoxy resin, and aliphatic epoxy compounds such as ethylene glycol diglycidyl ether, diethylene glycol diglycidyl ether, tripropylene glycol diglycidyl ether, polypropylene glycol diglycidyl ether, and 1,6-hexanediol diglycidyl ether.

In the present invention, the use of the aliphatic epoxy compound is preferred from the viewpoint of excellent adhesion and prevention of wrinkles when printing.

Concrete examples of the compound having two or more silanol groups or hydrolyzable silyl groups which is preferably used as the above-described specific compound include, but are not limited to, bis-(trimethoxysilyl)ethane, bis-(triethoxysilyl)ethane, bis-(trimethoxysilyl)propane, bis-(triethoxysilyl)propane, bis-(trimethoxysilyl)butane, bis-(triethoxysilyl)butane, bis-(trimethoxysilyl)heptane, bis-(triethoxysilyl)heptane, bis-(trimethoxysilyl)hexane, bis-(triethoxysilyl)hexane, bis-(trimethoxysilyl)octane, and bis-(triethoxysilyl) octane.

Concrete examples of the epoxy silane compound which is preferably used as the above-described specific compound include, but are not limited to, 2-(3,4-epoxycyclohexyl) ethyltrimethoxysilane, 3-glycidoxypropylmethyldimethoxysilane, 3-glycidoxypropyltrimethoxysilane, 3-glycidoxypropylmethyldiethoxysilane, and 3-glycidoxypropyltriethoxysilane.

In the present invention, the above-described specific compound can be one kind of compound or two or more kinds of compounds. From the viewpoint of adhesion to the heat resistant slipping layer, it is preferable to contain the epoxy silane compound.

In the present invention, from the viewpoint of excellent adhesion and prevention of wrinkles when printing, the content ratio of the above-described specific compound in the resin composition for primer layer is preferably 2 to 40 parts by mass, more preferably 5 to 35 parts by mass, particularly preferably 5 to 15 parts by mass, with respect to 100 parts by mass of the solid content in the resin composition for primer layer.

In the resin composition for primer layer used in the present invention, the ratio of the total number of the hydroxy groups, carboxy groups, amino groups, thiol groups and ions thereof in the resin (the functional groups of the resin) to the total number of the epoxy groups, the silanol groups and the hydrolyzable silyl groups in the above-described specific compound (the functional groups of the specific compound) is not particularly limited. From the viewpoint of preventing the heat resistant slipping layer from transferring to a guide roller, etc., and preventing wrinkles when printing, the equivalent ratio (molar ratio) of the above-described specific functional groups of the specific compound to the above-described specific functional groups of the resin is preferably in a range of 0.5 to 15, more preferably in a range of 1 to 10, still more preferably in a range of 1.2 to 3.

<Other Components>

The resin composition for primer layer may further contain other components, as long as the effects of the present invention are not impaired. Such components include an antistatic agent and a surfactant.

Examples of the antistatic agent include a fine powder of a metal oxide such as tin oxide, and an electroconductive material having a pi-conjugated structure, such as sulfonated polyaniline, polythiophene or polypyrrole.

The primer layer may be formed by the following method, for example: the resin composition for primer layer is produced by dissolving one or more kinds of resins selected from the above-mentioned urethane resins and polyester resins, the above-described specific compound and, as needed, other components in a solvent in which these components are soluble or dispersible; the resin composition is applied onto the substrate sheet by a gravure printing method, a reverse roll coating method using a gravure plate, a forming means such as a roll coater or bar coater; and the applied resin composition is dried and cured, thereby forming the primer layer. In the drying and curing step, heating may be carried out as needed. The applied amount of the primer layer is preferably such an amount that the solid content after drying is 0.4 to 1.0 g/m$^2$. By setting the applied amount of the primer layer to 0.4 g/m$^2$ or more, excellent heat resistance can be obtained, and wrinkles are less likely to occur in the thermal head when printing. By setting the applied amount of the primer layer to 1.0 g/m$^2$ or less, thermal conductivity from the thermal head to the thermal transfer layer can be obtained.

(Heat Resistant Slipping Layer)

In the thermal transfer sheet of the present invention, the heat resistant slipping layer is disposed on the opposite side from the thermal transfer layer side of the substrate sheet via the primer layer. The heat resistant slipping layer is provided for the purpose of increasing the runnability and heat resistance of the thermal head when printing.

In the present invention, by the use of the above-described specific primer layer, an increase in adhesion is obtained, and wrinkles are prevented when printing; therefore, the heat resistant slipping layer can be appropriately selected from conventionally known layers and used. From the viewpoint of heat resistance, it is preferable to use a thermoplastic resin having a glass transition temperature of 70 to 150° C.

Concrete examples of the thermoplastic resin include: polyester resins; cellulose resins such as an ethyl cellulose resin and a methyl cellulose resin; vinyl resins such as polyvinyl alcohol, polyvinylpyrrolidone, polyvinyl chloride and polyvinyl acetate resins; acrylic resins such as polyacrylic acid ester resins and styrene acrylate resins; polyolefin resins such as polyethylene resins and polypropylene resins; polyvinyl acetal resins such as a polyvinyl butyral resin and a polyvinyl acetoacetal resin; and other resins such as polyurethane resins, polystyrene resins, polyether resins, polyamide resins, polyimide resins, polyamideimide resins, polycarbonate resins and a polyacrylamide resin. The resins can be used alone or in combination of two or more kinds. In the present invention, it is particularly preferable to contain a hydroxyl group-containing thermoplastic resin. By use of the hydroxyl group-containing thermoplastic resin, the adhesion between the primer layer and the heat resistant slipping layer is further increased, since the resin is able to cause a crosslinking reaction with the above-described specific compound in the primer layer, etc.

Examples of the hydroxyl group-containing thermoplastic resin include cellulose resins, vinyl resins, polyvinyl acetal resins, polyamideimide resins, polyurethane resins and acrylic resins. Of them, polyvinyl acetal resins having many hydroxyl groups per molecule, such as polyvinyl butyral resins and polyacetoacetal resins, are preferred from the viewpoint of adhesion to the primer layer.

When the hydroxyl group-containing thermoplastic resin is used as the thermoplastic resin of the heat resistant slipping layer, it is preferable to use a polyisocyanate compound in combination. A crosslinking reaction occurs between the hydroxy group of the hydroxyl group-containing thermoplastic resin and the isocyanate group of the polyisocyanate compound, thereby increasing the heat resistance and strength of the heat resistant slipping layer.

Conventionally known compounds may be used as the polyisocyanate compound, without any particular limitation. Of them, it is preferable to use an adduct of an aromatic polyisocyanate. Examples of the aromatic polyisocyanate include 2,4-toluene diisocyanate, 2,6-toluene diisocyanate, a mixture of 2,4-toluene diisocyanate and 2,6-toluene diisocyanate, 1,5-naphthalene diisocyanate, tolidine diisocyanate, p-phenylene diisocyanate, trans-cyclohexane-1,4-diisocyanate, xylylene diisocyanate, triphenylmethane triisocyanate, and tris(isocyanatophenyl) thiophosphate. Particularly preferred are 2,4-toluene diisocyanate, 2,6-toluene diisocyanate, and a mixture of 2,4-toluene diisocyanate and 2,6-toluene diisocyanate.

From the viewpoint of increasing the slipping ability between the heat resistant slipping layer and the thermal head, it is preferable that a lubricant component such as a metallic soap, phosphoric acid ester, polyethylene wax, talc or silicone resin fine particles, is contained in the heat resistant slipping layer. For auxiliary control of slipping ability, it is preferable that additives such as inorganic or organic fine particles and a silicone oil are contained in the heat resistant slipping layer. It is particularly preferable that at least one of a phosphoric acid ester and a metallic soap is contained in the heat resistant slipping layer. For charge prevention, electroconductive carbon may be contained in the heat resistant slipping layer.

The heat resistant slipping layer can be formed as follows, for example: the above-mentioned thermoplastic resin and additives that are added as needed, are dispersed or dissolved in an appropriate solvent to prepare a coating solution, and the coating solution is applied by a conventionally known method such as gravure coating or gravure reverse coating and is dried, thereby forming the heat resistant slipping layer.

The applied amount of the heat resistant slipping layer is not particularly limited. From the viewpoint of increasing heat resistance, etc., it is preferably 0.01 $g/m^2$ to 0.2 $g/m^2$ when dried.

(Thermal Transfer Layer)

In the present invention, the thermal transfer layer is a layer including at least one of a color transfer layer and a transferable protective layer, and it is also a layer that is transferred to a transfer receiving medium by heat.

When the thermal transfer sheet of the present invention is a sublimation thermal transfer sheet, the color transfer layer is a sublimation color layer containing a sublimation dye. In this case, the sublimation dye is transferred. Meanwhile, when the thermal transfer sheet is a thermofusible thermal transfer sheet, the color transfer layer is a thermofusible color layer composed of a thermofusible composition containing a color material. Hereinafter, the case of the sublimation thermal transfer sheet will be explained as a typical example. However, the present invention is not limited to the sublimation thermal transfer sheet only.

The sublimation dye contained in the sublimation color layer may be any conventionally known dye. Preferred is a dye having excellent properties as a printing material, such as a dye having sufficient coloring density and being resistant to color degradation induced by light, heat, temperature, etc. Examples of the dye include: diarylmethane dyes; triarylmethane dyes; thiazole dyes; melocyanine dyes; pyrazolone dyes; methine dyes such as pyrazolone methine and pyridone methine; indoaniline dyes; indonaphthol dyes; azomethine dyes such as acetophenone azomethine, pyrazolo azomethine, pyrazolone azomethine, pyrazolotriazole azomethine, imidazole azomethine, imidazo azomethine and pyridone azomethine; xanthene dyes; oxazine dyes; cyanostyrene dyes such as dicyanostyrene and tricyanostyrene; thiazine dyes; azine dyes; acridine dyes; benzene azo dyes; azo dyes such as pyridone azo, thiophene azo, thiazole azo, isothiazole azo, pyrrole azo, pyrazole azo, imidazole azo, thiadiazole azo, triazole azo and disazo; spiropyran dyes; indolinospiropyran dyes; fluoran dyes; rhodamine lactam dyes; naphthoquinone dyes; anthraquinone dyes; quinophthalone dyes; aminopyrazole dyes; pyrazolotriazole dyes; and styryl dyes such as dicyanostyryl and tricyanostyryl. More specifically, there may be mentioned red dyes such as Disperse Red 60, Disperse Violet 26, Ceres Red 7B and Samaron Red F3BS; yellow dyes such as Disperse Yellow 231, PTY-52 and Macrolex Yellow 6G; and blue dyes such as Solvent Blue 63, Waxoline Blue AP-FW, Foron Brilliant Blue S-R, MS Blue 100 and C. I. Solvent Blue 22.

A binder resin is used to support the dye. Examples thereof include: cellulose resins such as an ethyl cellulose resin, a hydroxyethyl cellulose resin, an ethylhydroxy cellulose resin, a methyl cellulose resin, a nitrocellulose resin and a cellulose acetate resin; vinyl resins such as a polyvinyl alcohol resin, a polyvinyl acetate resin, a polyvinyl butyral resin, a polyvinyl acetal resin and polyvinylpyrrolidone; acrylic resins such as poly(meth) acrylate and poly(meth) acrylamide; polyurethane resins; polyamide resins; and polyester resins. Of them, cellulose, vinyl, acrylic, polyurethane and polyester resins are preferred from the viewpoint of heat resistance and dye transferability.

An additive such as inorganic fine particles or organic fine particles may be contained in the sublimation color layer. Examples of the inorganic fine particles include carbon black, silica, alumina, titanium dioxide and molybdenum disulfide. Examples of the organic fine particles include a polyethylene wax. Also, a release agent may be contained in the sublimation color layer. Examples of the release agent include a silicone oil and a phosphoric acid ester.

The method for forming the sublimation color layer is as follows, for example: the above-mentioned dye and binder resin are mixed with additives as needed, such as a release agent and a filler; the resulting mixture is dispersed or dissolved in an appropriate solvent such as toluene, methyl ethyl ketone, ethanol, isopropyl alcohol, cyclohexane or dimethylformamide to prepare a coating solution; the coating solution is applied onto a substrate by, for example, a gravure printing method, a reverse roll coating method using a gravure plate, a forming means such as a roll coater or bar coater and is dried, thereby forming the sublimation color layer.

(Transferable Protective Layer)

In the thermal transfer sheet of the present invention, the above-described color layer and transferable protective layer may be sequentially disposed side by side. The transferable protective layer is a layer that is used for image surface protection after printing and that coats an image receiving sheet after printing to form a protective layer.

The transferable protective layer may have a multi-layer structure or single-layer structure. When the transferable protective layer has a multi-layer structure, it may include the following: a main protective layer for playing a main role in providing various resistant properties to an image; an adhesive layer that is disposed on the outermost surface of the transferable protective layer to increase adhesion between the transferable protective layer and the image receiving surface of a printed product; an auxiliary protective layer; and a layer for imparting functions other than the function of the protective layer itself. The order of the main protective layer and the other layers can be determined as desired. In general, the other layers are disposed between the adhesive layer and the main protective layer so that the main protective layer will be the outermost surface layer of the image receiving surface after transfer.

The main protective layer constituting the transferable protective layer having the multi-layer structure or the transferable protective layer having the single-layer structure, may be formed from various kinds of resins that are known as resins for forming a protective layer. Examples of such resins include a polyester resin, a polystyrene resin, an acrylic resin, a polyurethane resin, an acrylic urethane resin and resins obtained by silicone modifying these resins, mixtures of these resins, an ionizing radiation curable resin, and a UV shielding resin.

The protective layer containing an ionizing radiation curable resin is particularly excellent in resistance to plasticizers and abrasion. Any known ionizing radiation curable resin can be used as the ionizing radiation curable resin. For example, a protective layer obtained by crosslinking and curing a radically polymerizable polymer or oligomer by ionizing radiation may be used, or a protective layer obtained by polymerizing and crosslinking the curable resin that may contain a photopolymerization initiator as needed by electron beams or UV, may be used.

The main purpose of the protective layer containing a UV shielding resin is to provide light resistance to a printed product. As the UV shielding resin, for example, a resin obtained by reacting and binding a reactive UV absorber with a thermoplastic resin or the above-mentioned ionizing radiation curable resin, may be used. More specifically, as the reactive UV absorber, there may be mentioned a UV absorber obtained by introducing a reactive group (such as an addition polymerizable double bond (e.g., a vinyl group, an acryloyl group, a methacryloyl group), an alcoholic hydroxyl group, an amino group, a carboxyl group, an epoxy group or an isocyanate group) into a conventionally-known, non-reactive organic UV absorber (such as a salicylate-based, benzophenone-based, benzotriazole-based, substituted acrylonitrile-based, nickel chelate-based or hindered amine-based UV absorber).

In general, the thickness of the transferable protective layer having the single-layer structure or that of the main protective layer in the transferable protective layer having the multi-layer structure, is preferably about 0.5 to 10 μm, depending on the type of the resin for forming protective layer.

An adhesive layer may be formed on the outermost surface of the transferable protective layer. For example, the adhesive layer may be formed from a resin that is excellent in adhesion when heating, such as an acrylic resin, a vinyl chloride resin, a vinyl acetate resin, a vinyl chloride/vinyl acetate copolymer resin, a polyester resin or a polyamide resin. The thickness of the adhesive layer is generally about 0.1 to 5 μm. Also, a thermal transfer layer side primer layer to be described below may be formed in a desired position in the multi-layer structure of the transferable protective layer.

The transferable protective layer can be formed as follows: the resin and other additives added as needed are dissolved or dispersed in a solvent to prepare a coating solution; next, the coating solution is applied onto the substrate by a well-known means such as a gravure printing method, a screen printing method, or a reverse roll coating method using a gravure plate and is dried, thereby forming the transferable protective layer.

The thickness of the transferable protective layer is not particularly limited. In general, it is preferably 0.5 to 10 μm, particularly preferably 1 to 5 μm.

<Other Layers>

The thermal transfer sheet used in the present invention may further include other layers. For example, to increase the adhesion between the substrate sheet and the thermal transfer layer, a thermal transfer layer side primer layer may be provided between the substrate sheet and the thermal transfer layer.

The resin constituting the thermal transfer layer side primer layer may be appropriately selected from conventionally known resins and used. Concrete examples of such resins include polyester resins, a polyvinylpyrrolidone resin, a polyvinyl alcohol resin, hydroxyethyl cellulose, polyacrylic acid ester resins, polyvinyl acetate resins, polyurethane resins, styreneacrylate resins, polyacrylamide resins, polyamide resins, polyether resins, polystyrene resins, polyolefin resins, a polyvinyl chloride resin, and polyvinyl acetal resins such as polyvinyl acetoacetal and polyvinyl butyral. The resin constituting the thermal transfer layer side primer layer may be one kind of resin or a combination of two or more kinds of resins.

The present invention is not limited to the above-mentioned embodiments. The above-mentioned embodiments are examples, and any that has the substantially same essential features as the technical ideas described in claims of the present invention and exerts the same effects and advantages is included in the technical scope of the present invention.

EXAMPLES

The present invention will be further described by way of examples and comparative examples, in which all designations of part(s) and % are expressed on mass basis, unless otherwise noted. The scope of the present invention is not restricted by these examples.

Example 1: Production of Thermal Transfer Sheet 1

A polyethylene terephthalate film subjected to an adhesion-enhancing treatment, the film having a thickness of 4.5 μm, was used as a substrate sheet. Onto the film, a resin composition 1 for primer layer, the resin composition having the following composition, was applied so as to be 0.05 g/m$^2$ when dried. The applied resin composition was dried to form a primer layer. Then, a composition for heat resistant slipping layer, the composition having the following composition, was applied so as to be 0.5 g/m$^2$ when dried, thereby forming a heat resistant slipping layer. Then, a composition for transferable protective layer, the composition having the following composition, was applied to a part of an opposite side from the heat resistant slipping layer side of the substrate sheet so that the applied amount becomes 1.0 g/m$^2$ when dried. The applied composition was dried to form a transferable protective layer. Then, a composition for thermal transfer layer side primer layer, the composition having the following composition, was applied to the whole surface of an opposite side from the heat resistant slipping layer side of the substrate sheet so that the applied amount becomes 0.10 g/m$^2$ when dried. The applied composition was dried to form a thermal transfer layer side primer layer. Then, a composition for yellow (Y) color transfer layer, a composition for magenta (M) color transfer layer, a composition for cyan (Cy) color transfer layer, and a composition for adhesive layer for transferable protective layer, the compositions having the following compositions, were each applied and dried on the thermal transfer layer side primer layer sequentially side by side in this order so that the applied amount becomes 0.6 g/m$^2$ (in the case of the compositions for color transfer layers) and 1.2 g/m$^2$ (in the case of the composition for adhesive layer) when dried. Therefore, a thermal transfer sheet 1 as shown in FIG. 3 was obtained.

<Resin Composition 1 for Primer Layer>

- Urethane resin having a carboxy group ("HYDRAN AP40N" manufactured by DIC Corporation, Tg 55° C., solid content 35%): 8 Parts
- Epoxy silane compound ("WSA950" manufactured by DIC Corporation): 0.3 Part
- Water: 10 Parts
- Modified ethanol: 50 Parts In the resin composition 1 for primer layer, the equivalent ratio of the total number of the above-described specific functional groups of the epoxy silane compound to the total number of the above-described specific functional groups of the aqueous urethane resin, was 2.

<Composition for Heat Resistant Slipping Layer>

- Molar equivalent ratio of the isocyanate group of polyisocyanate to the hydroxyl group of polyvinyl acetal resin (—NCO/—OH): 0.50
- Polyvinyl acetal ("S-LEC KS-1" manufactured by Sekisui Chemical Co., Ltd., hydroxyl value 12% by mass): 47.6 Parts
- Polyisocyanate ("BURNOCK D750" manufactured by DIC Corporation, NCO 17.3% by mass): 15.0 Parts
- Silicone resin fine particles ("TOSPEARL 240" manufactured by Momentive Performance Materials Inc., average particle diameter 4 μm, polygonal-shaped): 1 Part
- Zinc stearyl phosphate ("LBT-1830 purified" manufactured by Sakai Chemical Industry Co., Ltd.): 12 Parts
- Zinc stearate ("SZ-PF" manufactured by Sakai Chemical Industry Co., Ltd.): 12 Parts
- Polyethylene wax ("POLYWAX 3000" manufactured by Toyo Petrolite Co., Ltd.): 3.5 Parts
- Ethoxylated alcohol-modified wax ("UNITHOX 750" manufactured by Toyo Adl Corporation): 8.5 Parts
- Methyl ethyl ketone: 200 Parts
- Toluene: 100 Parts <Composition for Transferable Protective Layer>

- Acrylic resin ("BR-87" manufactured by Mitsubishi Rayon Co., Ltd.): 70 Parts
- Styrene acrylic resin ("BR-52" manufactured by Mitsubishi Rayon Co., Ltd.): 30 Parts
- Talc ("P-3" manufactured by NIPPON TALC Co., Ltd.): 3 Parts
- Dispersant ("BYK-180" manufactured by BYK Japan KK): 0.5 Part
- Release agent ("Plysurf A208N" manufactured by DKS Co. Ltd.): 3 Parts
- Adhesive ("VYLON 220" manufactured by Toyobo Co., Ltd.): 1 Part
- n-Propyl acetate: 60 Parts
- Methyl ethyl ketone: 240 Parts <Composition for Thermal Transfer Layer Side Primer Layer>

- Alumina sol ("Alumina Sol 200" (in feather form) manufactured by Nissan Chemical Industries, Ltd., solid content 10%): 50 Parts
- Polyvinylpyrrolidone resin ("K-90" manufactured by ISP): 5 Parts
- Water: 25 Parts
- Isopropyl alcohol: 20 Parts <Composition for Yellow (Y) Color Layer>

- Dye represented by the following chemical formula (I): 2.0 Parts
- Polyvinyl acetoacetal resin ("KS-5" manufactured by Sekisui Chemical Co., Ltd.): 4.5 Parts
- Silicone oil ("KF-354L" manufactured by Shin-Etsu Chemical Co., Ltd.): 0.045 Part
- Polyethylene wax: 0.1 Part
- Methyl ethyl ketone: 45.0 Parts
- Toluene: 45.0 Parts Chemical Formula (I)

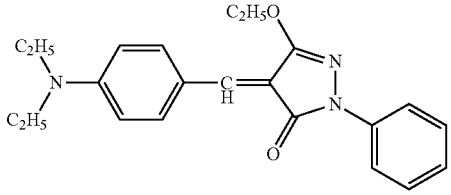

<Composition for Magenta (M) Color Layer>

Dye represented by the following chemical formula (II): 2.0 Parts

Polyvinyl acetoacetal resin ("KS-5" manufactured by Sekisui Chemical Co., Ltd.): 4.5 Parts Silicone oil ("KF-354L" manufactured by Shin-Etsu Chemical Co., Ltd.): 0.045 Part Polyethylene wax: 0.1 Part Methyl ethyl ketone: 45.0 Parts Toluene: 45.0 Parts Chemical Formula (II)

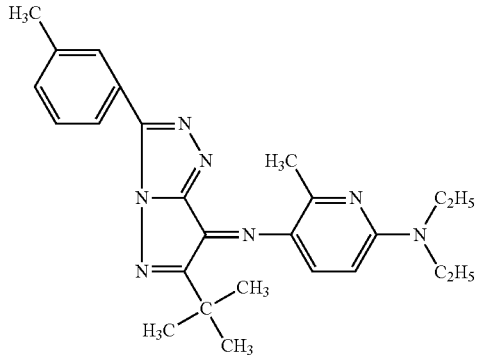

<Composition for Cyan (Cy) Color Layer>

Dye represented by the following chemical formula (III): 2.0 Parts

Polyvinyl acetoacetal resin ("KS-5" manufactured by Sekisui Chemical Co., Ltd.): 4.5 Parts Silicone oil ("KF-354L" manufactured by Shin-Etsu Chemical Co., Ltd.): 0.045 Part Polyethylene wax: 0.1 Part Methyl ethyl ketone: 45.0 Parts Toluene: 45.0 Parts Chemical Formula (III)

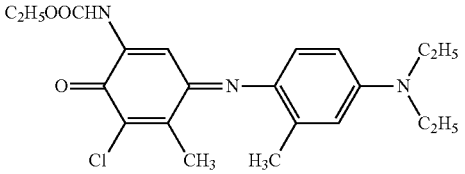

<Composition for Adhesive Layer>

Vinyl chloride-vinyl acetate copolymer resin ("SOLBIN CNL" manufactured by Nissin Chemical Industry Co., Ltd., number average molecular weight 12000, Tg 76° C.): 50 Parts UV absorber ("TINUVIN 928" manufactured by Ciba Japan K.K.): 8.5 Parts Silica filler ("Sylysia 310P" manufactured by Fuji Silysia Chemical Ltd.): 1.5 Parts n-Propyl acetate: 15 Parts Methyl ethyl ketone: 60 Parts Example 2: Production of Thermal Transfer Sheet 2

The thermal transfer sheet 2 was produced in the same manner as Example 1, except that in the production of the thermal transfer sheet 1, the resin composition 1 for primer layer was changed to a resin composition 2 for primer layer, the resin composition having the following composition:

<Resin Composition 2 for Primer Layer>

Urethane resin having a carboxy group ("HYDRAN AP40N" manufactured by DIC Corporation, Tg 55° C., solid content 35%): 8 Parts Epoxy silane compound ("WSA950" manufactured by DIC Corporation): 0.375 Part Water: 10 Parts Modified ethanol: 50 Parts In the resin composition 2 for primer layer, the equivalent ratio of the total number of the above-described specific functional groups of the epoxy silane compound to the total number of the above-described specific functional groups of the aqueous urethane resin, was 2.5.

Example 3: Production of Thermal Transfer Sheet 3

The thermal transfer sheet 3 was obtained in the same manner as Example 1, except that in the production of the thermal transfer sheet 1, the resin composition 1 for primer layer was changed to a resin composition 3 for primer layer, the resin composition having the following composition:

<Resin Composition 3 for Primer Layer>

Urethane resin having a carboxy group ("HYDRAN AP40N" manufactured by DIC Corporation, Tg 55° C., solid content 35%): 8 Parts Epoxy silane compound ("WSA950" manufactured by DIC Corporation): 0.225 Part Water: 10 Parts Modified ethanol: 50 Parts In the resin composition 3 for primer layer, the equivalent ratio of the total number of the above-described specific functional groups of the epoxy silane compound to the total number of the above-described specific functional groups of the aqueous urethane resin, was 1.5.

Example 4: Production of Thermal Transfer Sheet 4

The thermal transfer sheet 4 was obtained in the same manner as Example 1, except that in the production of the thermal transfer sheet 1, the resin composition 1 for primer layer was changed to a resin composition 4 for primer layer, the resin composition having the following composition:

<Resin Composition 4 for Primer Layer>

Urethane resin having a carboxy group ("HYDRAN AP40N" manufactured by DIC Corporation, Tg 55° C., solid content 35%): 8 Parts Epoxy silane compound ("WSA950" manufactured by DIC Corporation): 0.75 Part Water: 10 Parts Modified ethanol: 50 Parts In the resin composition 4 for primer layer, the equivalent ratio of the total number of the above-described specific functional groups of the epoxy silane compound to the total number of the above-described specific functional groups of the aqueous urethane resin, was 5.

Example 5: Production of Thermal Transfer Sheet 5

The thermal transfer sheet 5 was obtained in the same manner as Example 1, except that in the production of the thermal transfer sheet 1, the resin composition 1 for primer layer was changed to a resin composition 5 for primer layer, the resin composition having the following composition:

<Resin Composition 5 for Primer Layer>

Urethane resin having a carboxy group ("HYDRAN AP40N" manufactured by DIC Corporation, Tg 55° C., solid content 35%): 8 Parts Epoxy silane compound ("WSA950" manufactured by DIC Corporation): 1.5 Parts Water: 10 Parts Modified ethanol: 50 Parts In the resin composition 5 for primer layer, the equivalent ratio of the total number of the above-described specific functional groups of the epoxy silane compound to the total number of the above-described specific functional groups of the aqueous urethane resin, was 10.

Example 6: Production of Thermal Transfer Sheet 6

The thermal transfer sheet 6 was obtained in the same manner as Example 1, except that in the production of the thermal transfer sheet 1, the resin composition 1 for primer layer was changed to a resin composition 6 for primer layer, the resin composition having the following composition:

<Resin Composition 6 for Primer Layer>

Urethane resin having a carboxy group ("HYDRAN AP40N" manufactured by DIC Corporation, Tg 55° C., solid content 35%): 8 Parts Polyfunctional aliphatic epoxy compound ("CR5L" manufactured by DIC Corporation): 0.2 Part Water: 10 Parts Modified ethanol: 50 Parts In the resin composition 6 for primer layer, the equivalent ratio of the total number of the above-described specific functional groups of the polyfunctional aliphatic epoxy compound to the total number of the above-described specific functional groups of the aqueous urethane resin, was 10.

Example 7: Production of Thermal Transfer Sheet 7

The thermal transfer sheet 7 was obtained in the same manner as Example 1, except that in the production of the thermal transfer sheet 1, the resin composition 1 for primer layer was changed to a resin composition 7 for primer layer, the resin composition having the following composition:

<Resin Composition 7 for Primer Layer>

Polyester resin having a carboxy group ("PLAS COAT Z-730" manufactured by GOO Chemical Co., Ltd., Tg 46° C., solid content 25%): 8 Parts Epoxy silane compound ("WSA950" manufactured by DIC Corporation): 0.3 Part Water: 10 Parts Modified ethanol: 50 Parts Comparative Example 1: Production of Comparative Thermal Transfer Sheet 1

The comparative thermal transfer sheet 1 was obtained in the same manner as Example 1, except that in the production of the thermal transfer sheet 1, the resin composition 1 for primer layer was changed to a resin composition 1 for comparative primer layer, the resin composition having the following composition and not containing the above-described specific compound:

<Resin Composition 1 for Comparative Primer Layer>

Urethane resin having a carboxy group ("HYDRAN AP40N" manufactured by DIC Corporation): 8 Parts Water: 10 Parts Modified ethanol: 50 Parts Comparative Example 2: Production of Comparative Thermal Transfer Sheet 2

The comparative thermal transfer sheet 2 was obtained in the same manner as Example 1, except that in the production of the thermal transfer sheet 1, the resin composition 1 for primer layer was changed to a resin composition 2 for comparative primer layer, the resin composition having the following composition and not containing any polyfunctional compound:

<Resin Composition 2 for Comparative Primer Layer>

Polyester resin having a carboxy group ("PLAS COAT Z-730" manufactured by GOO Chemical Co., Ltd.): 8 Parts Water: 10 Parts Modified ethanol: 50 Parts Comparative Example 3: Production of Comparative Thermal Transfer Sheet 3

The comparative thermal transfer sheet 3 was obtained in the same manner as Example 1, except that in the production of the thermal transfer sheet 1, the resin composition 1 for primer layer was changed to a resin composition 3 for comparative primer layer, the resin composition having the following composition:

<Resin Composition 3 for Comparative Primer Layer>

Polyvinyl alcohol ("KURARAY POVAL PVA-117" manufactured by Kuraray Co., Ltd., solid content 100%, polymerization degree 1700): 2.67 Parts Titanium chelate agent ("ORGATIX TC-300" manufactured by Matsumoto Fine Chemical Co., Ltd., solid content 42% by mass): 5.55 Parts Water: 45.89 Parts Modified ethanol: 45.89 Parts Comparative Example 4: Production of Comparative Thermal Transfer Sheet 4

The comparative thermal transfer sheet 4 was obtained in the same manner as Example 1, except that in the production of the thermal transfer sheet 1, the resin composition 1 for primer layer was changed to a resin composition 4 for comparative primer layer, the composition having the following composition:

<Resin Composition 4 for Comparative Primer Layer>

Aqueous acrylic emulsion ("BARIASTAR B-1000" manufactured by Mitsui Chemicals, Inc., solid content 20%): 100 Parts Carbodiimide crosslinking agent ("CARBODILITE SV-02" manufactured by Nisshinbo Chemical Inc.): 20 Parts Water: 270 Parts Modified ethanol: 270 Parts (Production of Thermal Transfer Image Receiving Sheet)

To one side of a microvoid film having a thickness of 39 μm and including a microporous layer, a composition for forming adhesive layer, the composition having the following composition, was applied. The microvoid film was attached to a support in which a back layer is provided on one side of a coated paper (186 g/m$^2$) so that the composition-applied side of the film attaches to an opposite side from the back layer side of the support.

<Composition for Forming Adhesive Layer>

Polyfunctional polyol ("Takelac A-969V" manufactured by Mitsui Chemicals, Inc.): 30.0 Parts Isocyanate ("Takenate A-5" manufactured by Mitsui Chemicals, Inc.): 10.0 Parts Ethyl acetate: 60.0 Parts Then, to an opposite side from the adhesive layer side of the microvoid film, a composition for forming primer layer for dye receiving layer, the composition having the following composition, was applied by wire bar coating so that the applied amount becomes 2.0 g/m$^2$ when dried. The applied composition was dried, thereby forming a primer layer for dye receiving layer.

<Composition for Forming Primer Layer for Dye Receiving Layer>

Polyester polyol ("ADCOAT" manufactured by Toyo-Morton, Ltd.): 15.0 Parts

Methyl ethyl ketone/toluene (at a mass ratio of 2:1): 85.0 Parts

On the primer layer thus formed, a composition for forming dye receiving layer, the composition having the following composition, was applied by wire bar coating so that the applied amount becomes 4.0 g/m$^2$ when dried. The applied composition was dried to form a dye receiving layer, thereby obtaining a thermal transfer image receiving sheet.

<Composition for Forming Dye Receiving Layer>

Vinyl chloride-vinyl acetate copolymer resin ("SOLBIN C" manufactured by Nissin Chemical Industry Co., Ltd., vinyl chloride/vinyl acetate=87/13, number average molecular weight 31,000, glass transition temperature 70° C.): 20.0 Parts Carboxyl-modified silicone ("X-22-3701E" manufactured by Shin-Etsu Chemical Co., Ltd.): 1.0 Part Methyl ethyl ketone/toluene (at a mass ratio of 1:1): 79.0 Parts

[Evaluation of Thermal Transfer Sheets]

(1) Adhesion Evaluation (Adhesion Evaluation Under High Humidity Environment)

The thermal transfer sheets obtained in Examples and Comparative Examples were stored in an environment at 40° C. and 90% RH for 100 hours. After the storage, a piece of mending tape "CT405AP-18" (manufactured by Nichiban Co., Ltd.) was sufficiently attached to the heat resistant slipping layer of each thermal transfer sheet to evaluate whether the heat resistant slipping layer is peeled from the substrate when the piece is peeled in vertical and horizontal directions to the heat resistant slipping layer. The evaluation results are shown in Table 1.

<Adhesion Evaluation Criteria>

A: No peeling occurred between the heat resistant slipping layer and the substrate.

B: Space was left locally between the heat resistant slipping layer and the substrate; however, it was very small. No peeling of the heat resistant slipping layer occurred, and the quality of the thermal transfer sheet was not impaired.

C: Space was left between the heat resistant slipping layer and the substrate, and peeling occurred.

If adhesion is evaluated as A or B, it indicates that adhesion is evaluated as excellent.

(2) Evaluation of Occurrence of Wrinkles when Printing

Each of the thermal transfer sheets obtained in Examples and Comparative Examples was combined with the thermal transfer image receiving sheet. Ten solid patterns with 100% image density (255/255 gradation) were printed on the thermal transfer image receiving sheet of media set DS40PC (DM4640) for printer DS40 manufactured by DNP Fotolusio Co., Ltd. Then, wrinkles on a printed product thus obtained were observed.

<Evaluation Criteria of Occurrence of Wrinkles>

A: No wrinkles occurred in all of the ten solid patterns.

B: Wrinkles occurred in one or two of the ten solid patterns.

C: Wrinkles occurred in three or more of the ten solid patterns.

If the occurrence of wrinkles is evaluated as A or B, it indicates that the occurrence of wrinkles is sufficiently prevented.

TABLE 1

| | Primer layer | | | | Evaluation items | |
|---|---|---|---|---|---|---|
| | Resin content ratio (%) with respect to total solid content | | Compound content ratio (%) with respect to total solid content | | Adhesion | Occurrence of wrinkles when printing |
| Example 1 | Urethane resin | 90.3 | Epoxy silane compound | 9.7 | A | A |
| Example 2 | Urethane resin | 88.2 | Epoxy silane compound | 11.8 | A | A |
| Example 3 | Urethane resin | 92.6 | Epoxy silane compound | 7.4 | A | A |
| Example 4 | Urethane resin | 78.9 | Epoxy silane compound | 21.1 | A | B |
| Example 5 | Urethane resin | 65.1 | Epoxy silane compound | 34.9 | A | B |
| Example 6 | Urethane resin | 90.3 | Aliphatic epoxy compound | 9.7 | B | A |
| Example 7 | Polyester resin | 87.0 | Epoxy silane compound | 13.0 | B | A |
| Comparative Example 1 | Urethane resin | 100.0 | — | 0.0 | B | C |
| Comparative Example 2 | Polyester resin | 100.0 | — | 0.0 | B | C |
| Comparative | Polyvinyl alcohol | 32.5 | Titanium chelate | 67.5 | C | B |

TABLE 1-continued

| | Primer layer | | | | Evaluation items | |
|---|---|---|---|---|---|---|
| | Resin content ratio (%) with respect to total solid content | | Compound content ratio (%) with respect to total solid content | | Adhesion | Occurrence of wrinkles when printing |
| Example 3 | | | | | | |
| Comparative Example 4 | Acrylic emulsion | 83.3 | Carbodiimide crosslinking agent | 16.7 | C | A |

CONCLUSION

The thermal transfer sheet of Comparative Example 3 in which the primer layer was disposed between the substrate and the heat resistant slipping layer and the primer layer was composed of a combination of the polyvinyl alcohol and the titanium chelate, prevented the occurrence of wrinkles when printing. However, the thermal transfer sheet of Comparative Example 3 was poor in the adhesion of the heat resistant slipping layer. As with the thermal transfer sheet of Comparative Example 3, the thermal transfer sheet of Comparative Example 4 in which the primer layer was composed of a combination of the acrylic emulsion and the carbodiimide crosslinking agent, prevented the occurrence of wrinkles when printing and was poor in the adhesion of the heat resistant slipping layer. The heat resistant slipping layers of such thermal transfer sheets of Comparative Examples 3 and 4 were likely to attach to a guide roller.

The thermal transfer sheets of Comparative Examples 1 and 2 in which the urethane resin or polyester resin was used in the primer layer, was excellent in adhesion; however, wrinkles were likely to occur in the printed products.

In contrast, the thermal transfer sheets of Examples 1 to 7 in which a combination of the urethane resin or polyester resin and the above-described specific compound was used as the primer layer between the substrate and the heat resistant slipping layer, were excellent in adhesion and prevented the occurrence of wrinkles in the printed products. It is clear that especially the thermal transfer sheets of Examples 1 to 5 in which a combination of the urethane resin and the epoxy silane compound was used as the primer layer, are particularly excellent in adhesion, are highly effective in preventing the heat resistant slipping layer from transferring to the guide roller, etc., and are excellent in processability.

REFERENCE SIGNS LIST

1. Substrate sheet
2. Thermal transfer layer
2Y, 2M, 2Cy. Color transfer layer
2OP. Transferable protective layer
3. Primer layer
4. Heat resistant slipping layer
5. Main protective layer
6. Thermal transfer layer side primer layer
10. Thermal transfer sheet

The invention claimed is:

1. A thermal transfer sheet comprising a substrate sheet, a thermal transfer layer disposed on one side of the substrate sheet, and a heat resistant slipping layer disposed on the other side of the substrate sheet via a primer layer, wherein the primer layer comprises a cured product of a resin composition comprising one or more kinds of resins selected from a urethane resin and a polyester resin and a compound having a functional group selected from an epoxy group, a silanol group and a hydrolyzable silyl group.

2. The thermal transfer sheet according to claim 1, wherein the heat resistant slipping layer comprises a hydroxyl group-containing thermoplastic resin.

* * * * *